US009876269B2

(12) United States Patent
Boire et al.

(10) Patent No.: US 9,876,269 B2
(45) Date of Patent: Jan. 23, 2018

(54) MOBILE WIRELESS COMMUNICATIONS DEVICE WITH SPLIT ANTENNA FEED NETWORK AND RELATED METHODS

(71) Applicant: BLACKBERRY LIMITED, Waterloo (CA)

(72) Inventors: Daniel Charles Boire, Nashua, NH (US); Jeffrey Neal Schroeder, Nashua, NH (US); Andrew Joseph Sekelsky, Nashua, NH (US)

(73) Assignee: BLACKBERRY LIMITED, Waterloo (CA)

( * ) Notice: Subject to any disclaimer, the term of this patent is extended or adjusted under 35 U.S.C. 154(b) by 290 days.

(21) Appl. No.: 14/015,088

(22) Filed: Aug. 30, 2013

(65) Prior Publication Data

US 2015/0061944 A1 Mar. 5, 2015

(51) Int. Cl.

| | |
|---|---|
| ***H01Q 1/50*** | (2006.01) |
| ***H01Q 1/24*** | (2006.01) |
| ***H01Q 5/335*** | (2015.01) |
| ***H01Q 5/35*** | (2015.01) |

(52) U.S. Cl.

CPC ..... *H01Q 1/243* (2013.01); *H01Q 5/335* (2015.01); *H01Q 5/35* (2015.01); *Y10T 29/49016* (2015.01)

(58) Field of Classification Search

CPC ..... H01Q 21/0006; H01Q 1/50; H01Q 1/521; H01Q 21/28; H01Q 1/243; H01Q 9/265; H03H 7/42; H03H 7/38; H03H 7/465

See application file for complete search history.

(56) References Cited

U.S. PATENT DOCUMENTS

| | | | | |
|---|---|---|---|---|
| 6,950,073 | B2 | 9/2005 | Clymer et al. | |
| 7,379,515 | B2 | 5/2008 | Johnson et al. | |
| 7,403,166 | B2 | 7/2008 | Clymer et al. | |
| 7,791,549 | B2 | 9/2010 | Clymer et al. | |
| 8,134,510 | B2 | 3/2012 | Crouch et al. | |
| 8,457,581 | B2 | 6/2013 | Rofougaran et al. | |
| 2001/0038318 | A1 | 11/2001 | Johnson et al. | |
| 2008/0218429 | A1 | 9/2008 | Johnson et al. | |
| 2010/0311376 | A1 | 12/2010 | Rofougaran et al. | |
| 2011/0006952 | A1* | 1/2011 | Ayatollahi | H01Q 1/243 343/702 |
| 2011/0018776 | A1* | 1/2011 | Brown | H01Q 7/00 343/788 |

(Continued)

*Primary Examiner* — Graham Smith
*Assistant Examiner* — Noel Maldonado
(74) *Attorney, Agent, or Firm* — Guntin & Gust, PLC; Ralph Trementozzi

(57) ABSTRACT

A device may include a housing, a wireless transceiver carried by the housing, and an antenna element carried by the housing and having first and second feeds, and a split antenna feed network carried by the housing and providing a phase shift between the first and second feeds. The split antenna feed network may include a first capacitor having a first terminal coupled to the first feed and a second terminal coupled to the wireless transceiver, a second capacitor having a first terminal coupled to the second feed and a second terminal, a first inductor having a first terminal coupled to the second terminal of the first capacitor and a second terminal coupled to the second terminal of the second capacitor, and a second inductor having a first terminal coupled to the second terminal of the second capacitor and a second terminal coupled to a voltage reference.

30 Claims, 12 Drawing Sheets

(56) References Cited

U.S. PATENT DOCUMENTS

| | | | | |
|---|---|---|---|---|
| 2011/0215976 | A1 | 9/2011 | Clymer et al. | |
| 2012/0188917 | A1* | 7/2012 | Knox | 370/277 |
| 2013/0157601 | A1 | 6/2013 | O'Keeffee et al. | |
| 2013/0307742 | A1* | 11/2013 | Hu et al. | 343/821 |

* cited by examiner

MOBILE WIRELESS COMMUNICATIONS DEVICE WITH SPLIT ANTENNA FEED NETWORK AND RELATED METHODS

TECHNICAL FIELD

This application relates to the field of communications, and more particularly, to wireless communications systems and related methods.

BACKGROUND

Mobile communication systems continue to grow in popularity and have become an integral part of both personal and business communications. Various mobile devices now incorporate Personal Digital Assistant (PDA) features such as calendars, address books, task lists, calculators, memo and writing programs, media players, games, etc. These multi-function devices usually allow electronic mail (email) messages to be sent and received wirelessly, as well as access the internet via a cellular network and/or a wireless local area network (WLAN), for example.

As the functionality of cellular communications devices continues to increase, so too does demand for smaller devices that are easier and more convenient for users to carry. Nevertheless, the move towards multi-functional devices makes miniaturization more difficult as the requisite number of installed components increases. Indeed, the typical cellular communications may include several antennas, for example, a cellular antenna, a global positioning antenna, and a WiFi IEEE 802.11g antenna. These antennas may comprise external antennas and internal antennas.

As the internal space of the cellular communications device becomes more limited, it may be more difficult to achieve certain performance metrics. For example, some communications standards include out-of-band interference mitigation requirements. An approach to improving performance is to control the phase of a transmitted signal. In particular, there is a desire to control the phase shift of a transmitted signal at varying points in an antenna element.

DETAILED DESCRIPTION OF THE PREFERRED EMBODIMENTS

Figure 1:
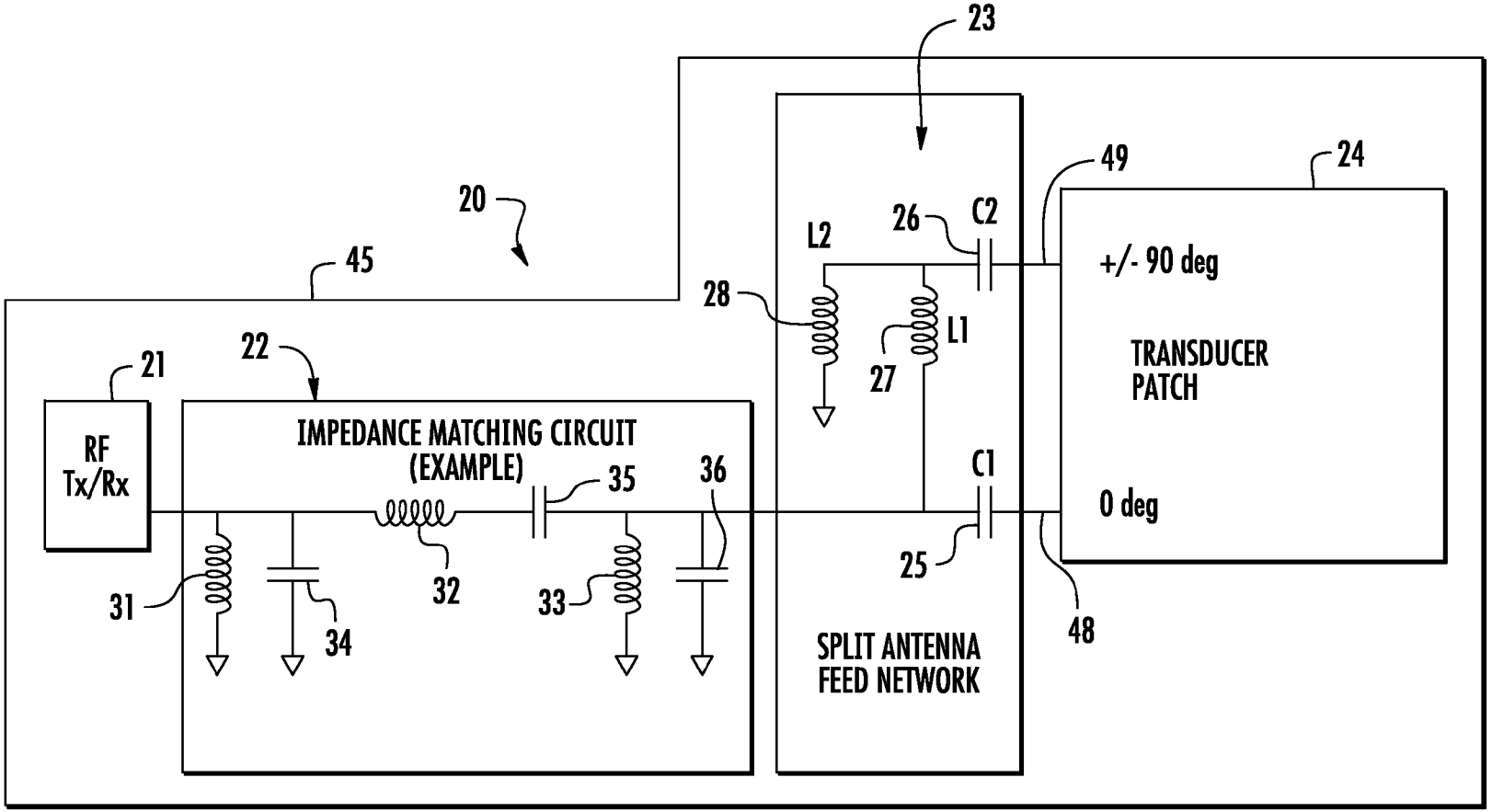
FIG. 1 is a schematic block diagram of an example embodiment of a mobile wireless communications device.

The present description is made with reference to the accompanying drawings, in which embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements or steps in alternative embodiments.

Generally speaking, a mobile wireless communications device may include a housing, a wireless transceiver carried by the housing, at least one antenna element carried by the housing and comprising first and second feeds, and a split antenna feed network carried by the housing and configured to provide a phase shift between the first and second feeds. The split antenna feed network may comprise a first capacitor having a first terminal coupled to the first feed and a second terminal coupled to the wireless transceiver, a second capacitor having a first terminal coupled to the second feed and a second terminal, a first inductor having a first terminal coupled to the second terminal of the first capacitor and a second terminal coupled to the second terminal of the second capacitor, and a second inductor having a first terminal coupled to the second terminal of the second capacitor and a second terminal coupled to a voltage reference.

Additionally, the first and second capacitors may each comprise a tunable capacitor. Each tunable capacitor may comprise at least one of a varactor, a tunable capacitor (such as a Paratek BST tunable capacitor, as available from Paratek Microwave Inc. of Nashua, N.H.), a semiconductor switched capacitor, and a microelectromechanical varactor.

The mobile wireless communications device may further comprise an impedance matching circuit coupled between the wireless transceiver and the split antenna feed network and configured to match impedances therebetween. In particular, the impedance matching circuit may comprise a third inductor having a first terminal coupled to the wireless transceiver and a second terminal, a third capacitor having a first terminal coupled to the second terminal of the third inductor and a second terminal coupled to the split antenna feed network, a fourth capacitor having a first terminal coupled to the wireless transceiver and a second terminal coupled to the reference voltage, a fourth inductor having a first terminal coupled to the wireless transceiver and a second terminal coupled to the reference voltage, a fifth capacitor having a first terminal coupled to the split antenna feed network and a second terminal coupled to the reference voltage, and a fifth inductor having a first terminal coupled to the split antenna feed network and second terminal coupled to the reference voltage.

In some embodiments, the split antenna feed network may be configured to provide a 90 degree phase shift between the first and second feeds. At least one antenna element may comprise a patch antenna element. At least one antenna element may comprise a multi-band antenna element, and the first feed may define a high band feed, and the second feed defines a low band feed.

Another aspect is directed to a mobile wireless communications device comprising a housing, a wireless transceiver carried by the housing, at least one antenna element carried by the housing and comprising first and second feeds, and a split antenna feed network carried by the housing and configured to provide a phase shift between the first and second feeds. The split antenna feed network may comprise a first capacitor having a first terminal coupled to the first feed and a second terminal coupled to the wireless transceiver, a second capacitor having a first terminal coupled to the second terminal of the first capacitor and a second terminal, a first inductor having a first terminal coupled to the second terminal of the second capacitor and a second terminal coupled to the second feed, and a second inductor having a first terminal coupled to the second terminal of the second capacitor and a second terminal coupled to a voltage reference.

Another aspect is directed to a method for making a split antenna feed network for a mobile wireless communications device having a wireless transceiver to be carried by a housing, and at least one antenna element to be carried by the housing and comprising first and second feeds, the split antenna feed network being coupled to the wireless transceiver and providing a phase shift between the first and second feeds. The method may comprise forming the split antenna feed network to comprise a first capacitor having a first terminal coupled to the first feed and a second terminal coupled to the wireless transceiver, a second capacitor having a first terminal coupled to the second feed and a second terminal, a first inductor having a first terminal coupled to the second terminal of the first capacitor and a second terminal coupled to the second terminal of the second capacitor, and a second inductor having a first terminal coupled to the second terminal of the second capacitor and a second terminal coupled to a voltage reference.

Another aspect is directed to a method for making a split antenna feed network for a mobile wireless communications device having a wireless transceiver to be carried by a housing, and at least one antenna element to be carried by the housing and comprising first and second feeds, the split antenna feed network being coupled to the wireless transceiver and providing a phase shift between the first and second feeds. The method may include forming the split antenna feed network to comprise a first capacitor having a first terminal coupled to the first feed and a second terminal coupled to the wireless transceiver, a second capacitor having a first terminal coupled to the second terminal of the first capacitor and a second terminal, a first inductor having a first terminal coupled to the second terminal of the second capacitor and a second terminal coupled to the second feed, and a second inductor having a first terminal coupled to the second terminal of the second capacitor and a second terminal coupled to a voltage reference.

Example mobile wireless communications devices may include portable or personal media players (e.g., music or MP3 players, video players, etc.), remote controls (e.g., television or stereo remotes, etc.), portable gaming devices, portable or mobile telephones, smartphones, tablet computers, etc.

Referring now to FIG. 1, a mobile wireless communications device 20 according to the present disclosure is now described. The mobile wireless communications device 20 includes a housing 45, a wireless transceiver 21 carried by the housing, an antenna element (e.g. metallic patch element) 24 carried by the housing and comprising first and second feeds 48-49, and a split antenna feed network 23 carried by the housing and configured to provide a phase shift between the first and second feeds. In particular, the split antenna feed network 23 is configured to provide a 90 degree phase shift between the first and second feeds 48-49. In some embodiments, the antenna element 24 comprises a multi-band antenna element, and the first feed 48 may define a high band feed, and the second feed 49 may define a low band feed.

The split antenna feed network 23 comprises a first capacitor 25 having a first terminal coupled to the first feed 48 and a second terminal coupled to the wireless transceiver 21, and a second capacitor 26 having a first terminal coupled to the second feed 49 and a second terminal. In particular, the first capacitor 25 may have a capacitance value of 0.5-3.0 pF, and the second capacitor 26 may have a capacitance value of 3.0-8.0 pF. In one embodiment, the first capacitor 25 has a capacitance value of 1.0 pF, and the second capacitor 26 has a capacitance value of 4.0 pF. The mobile wireless communications device 20 comprises a first inductor 27 having a first terminal coupled to the second terminal of the first capacitor 25 and a second terminal coupled to the second terminal of the second capacitor 26, and a second inductor 28 having a first terminal coupled to the second terminal of the second capacitor and a second terminal coupled to a voltage reference (e.g. the illustrated ground potential).

The mobile wireless communications device 20 comprises an impedance matching circuit 22 coupled between the wireless transceiver 21 and the split antenna feed network 23 and configured to match impedances therebetween. The impedance matching circuit 22 is designed to maximize the efficiency of the antenna element 24 when connected to the wireless transceiver 21. The exemplary impedance matching circuit 22 comprises a third inductor 32 having a first terminal coupled to the wireless transceiver 21 and a second terminal, a third capacitor 35 having a first terminal coupled to the second terminal of the third inductor and a second terminal coupled to the split antenna feed network 23, a fourth capacitor 34 having a first terminal coupled to the wireless transceiver and a second terminal coupled to the reference voltage, and a fourth inductor 31 in parallel to the fourth capacitor and having a first terminal coupled to the wireless transceiver and a second terminal coupled to the reference voltage. The impedance matching circuit 22 comprises a fifth capacitor 36 having a first terminal coupled to the split antenna feed network 23 and a second terminal coupled to the reference voltage, and a fifth inductor 33 in parallel to the fifth capacitor and having a first terminal coupled to the split antenna feed network and a second terminal coupled to the reference voltage.

Figure 3:
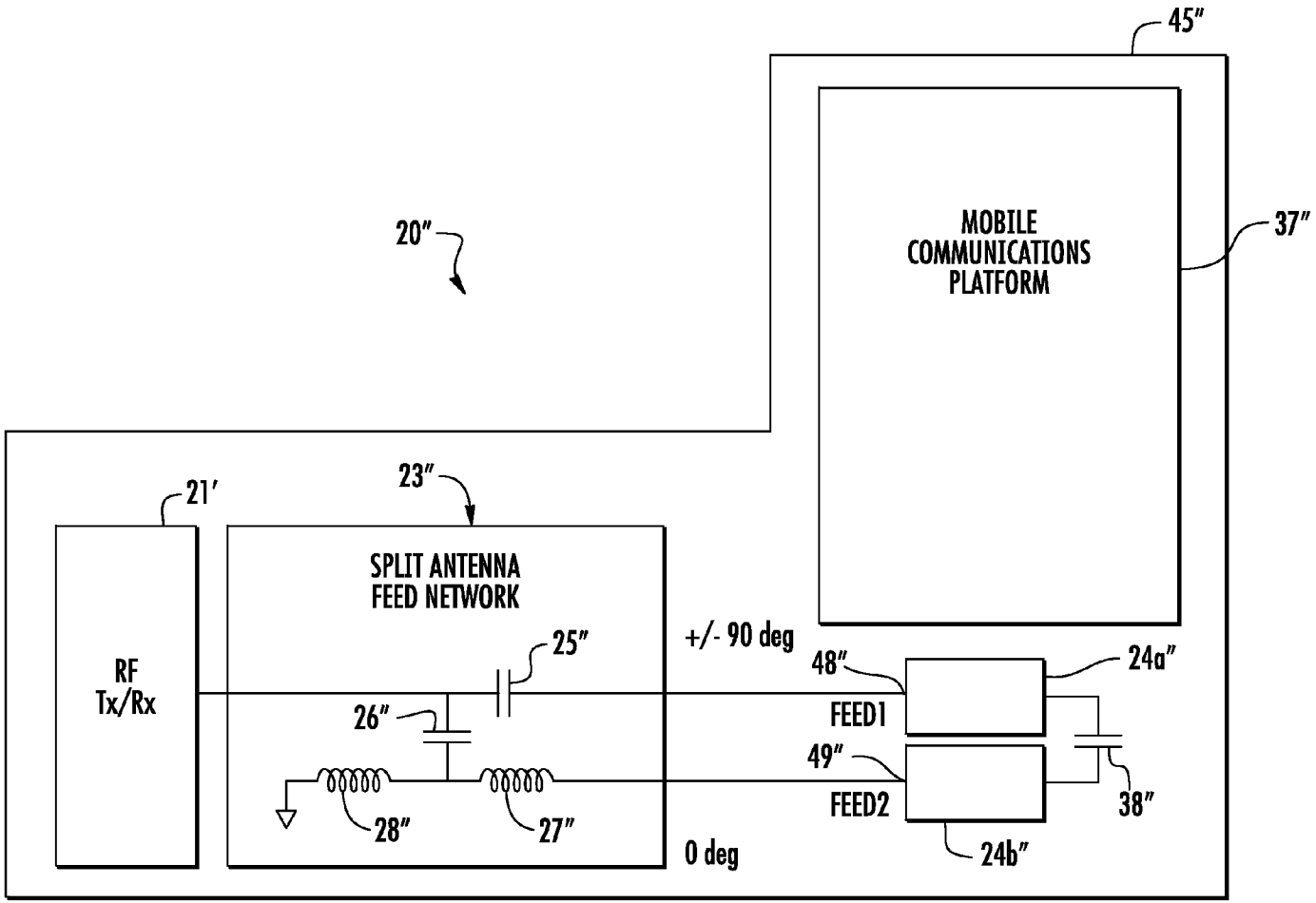
FIG. 3 is a schematic block diagram of another example embodiment of the mobile wireless communications device.

This represents one embodiment of an impedance matching circuit 22 in a PI network configuration. Alternatively, other impedance matching circuit configurations may be used to achieve the desired impedance matching characteristics. In some cases, the impedance matching circuit 22 may be as simple as one series or one shunt connected inductor or capacitor, or may even be omitted entirely (FIG. 3). The selection of an optimal circuit topology of the impedance matching circuit 22 will be appreciated to one skilled in the art of designing impedance matching circuits.

Another aspect is directed to a method for making a split antenna feed network 23 for a mobile wireless communications device 20 having a wireless transceiver 21 to be carried by a housing 45, and an antenna element 24 to be carried by the housing and comprising first and second feeds 48-49, the split antenna feed network being coupled to the wireless transceiver and providing a phase shift between the first and second feeds. The method may comprise forming the split antenna feed network 23 to comprise a first capacitor 25 having a first terminal coupled to the first feed 48 and a second terminal coupled to the wireless transceiver 21, a second capacitor 26 having a first terminal coupled to the second feed 49 and a second terminal, a first inductor 27 having a first terminal coupled to the second terminal of the first capacitor and a second terminal coupled to the second terminal of the second capacitor, and a second inductor 28 having a first terminal coupled to the second terminal of the second capacitor and a second terminal coupled to a voltage reference.

Figure 4:
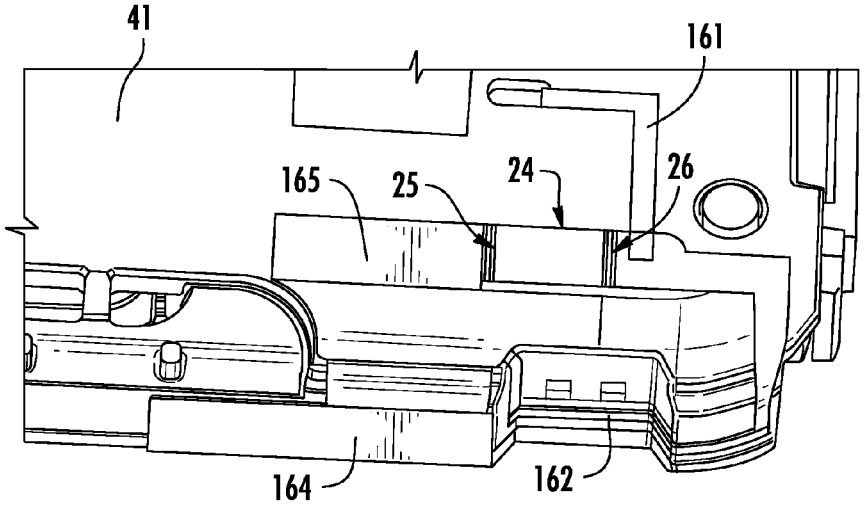
FIGS. 4-5 are perspective views of an example embodiment of an antenna from the mobile wireless communications device of FIG. 1.
Figure 5:
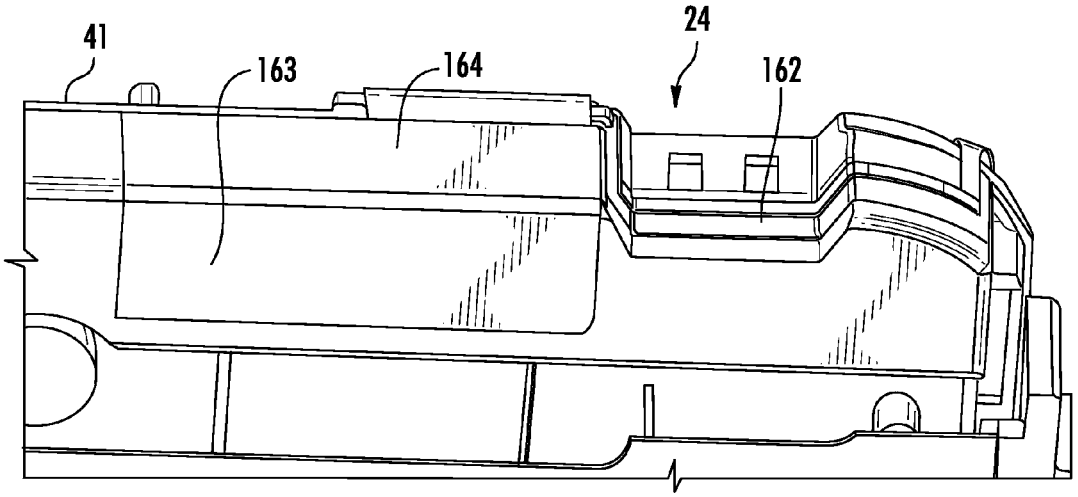

Referring briefly and additionally to FIGS. 4-5, an embodiment of antenna 24 for the mobile wireless communications device 20 is now described. The mobile wireless communications device 20 includes a carrier 41, and the antenna 24 is formed on the carrier. For example, the carrier 41 may comprise a dielectric, such as plastic. The antenna 24 extends across the peripheral edge of the carrier, and onto both major surfaces of the carrier.

More specifically, the antenna 24 illustratively includes a medial rectangle-shaped portion 165 extending along the back major surface of the carrier 41, a first L-shaped arm 161 extending from the medial rectangle-shaped portion and along the back major surface of the carrier, and a first rectangle-shaped portion 164 extending from the medial rectangle-shaped portion and along a bottom edge surface of the carrier. The antenna 24 illustratively includes a second rectangle-shaped portion 163 extending from the first rectangle-shaped portion 164 and along a front major surface of the carrier 41, and a second L-shaped arm 162 extending from the medial rectangle-shaped portion and along the bottom peripheral edge of the carrier.

The first L-shaped arm 161 connects to the second inductor 28. The connection to the impedance matching circuit 22 (not shown) is at the middle of the patch between the first and second capacitors 25, 26.

Figure 2:
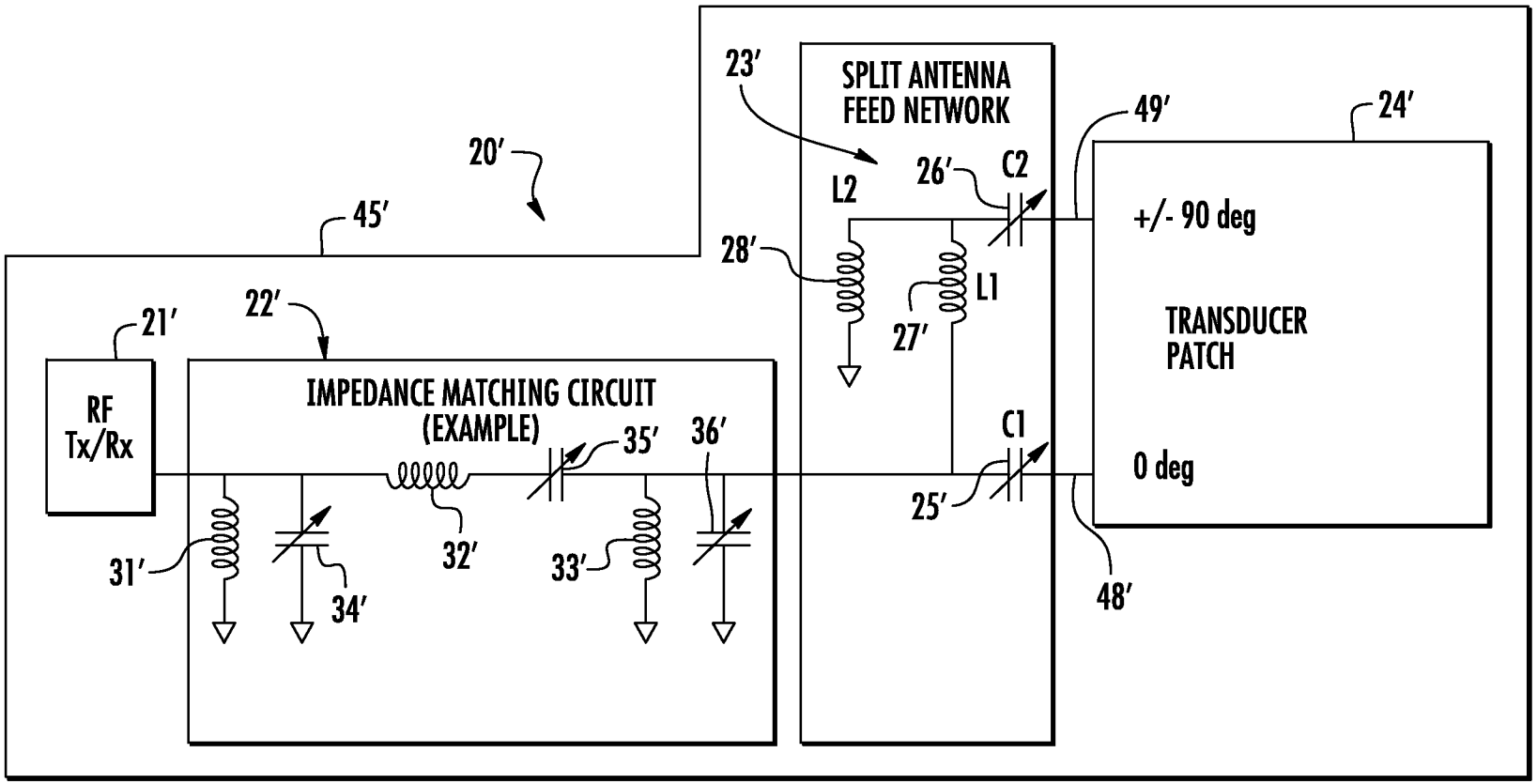
FIG. 2 is a schematic block diagram of another example embodiment of the mobile wireless communications device.

Referring now additionally to FIG. 2, another embodiment of the mobile wireless communications device 20' is now described. In this embodiment of the mobile wireless communications device 20', those elements already discussed above with respect to FIG. 1 are given prime notation and most require no further discussion herein. This embodiment differs from the previous embodiment in that this mobile wireless communications device 20' includes the first capacitor 25', the second capacitor 26', the third capacitor 35', the fourth capacitor 24', and the fifth capacitor 36' each comprising a tunable capacitor. For example, each tunable capacitor 24'-26', 35'-36' may comprise at least one of a varactor, a tunable capacitor, a varactor diode, a semiconductor switched capacitor, and a microelectromechanical varactor.

Referring now additionally to FIG. 3, another embodiment of the mobile wireless communications device 20" is now described. In this embodiment of the mobile wireless communications device 20", those elements already discussed above with respect to FIGS. 1-2 are given double prime notation and most require no further discussion herein. This embodiment differs from the previous embodiment in that this mobile wireless communications device 20" comprises a housing 45", a wireless transceiver 21" carried by the housing, first and second antenna elements **24*a*"-24*b*" carried by the housing and comprising first and second feeds 48"-49", and a split antenna feed network 23"** carried by the housing and configured to provide a phase shift between the first and second feeds.

The split antenna feed network 23" comprises a first capacitor 25" having a first terminal coupled to the first feed 48" and a second terminal coupled to the wireless transceiver 21", a second capacitor 26" having a first terminal coupled to the second terminal of the first capacitor and a second terminal, a first inductor 27" having a first terminal coupled to the second terminal of the second capacitor and a second terminal coupled to the second feed 49", and a second inductor 28" having a first terminal coupled to the second terminal of the second capacitor and a second terminal coupled to a voltage reference (e.g. the illustrated ground potential). The mobile wireless communications device 20" comprises a sixth capacitor 38" coupled between said first and second antenna elements **24*a*"-24*b*". The mobile wireless communications device 20" comprises a mobile communications platform 37" associated with the first and second antenna elements 24*a*"-24*b*"**.

Another aspect is directed to a method for making a split antenna feed network 23" for a mobile wireless communications device 20" having a wireless transceiver 21" to be carried by a housing 45", and first and second antenna elements **24*a*"-24*b*" to be carried by the housing and comprising first and second feeds 48"-49", the split antenna feed network being coupled to the wireless transceiver and providing a phase shift between the first and second feeds. The method may include forming the split antenna feed network 23" to comprise a first capacitor 25" having a first terminal coupled to the first feed 48" and a second terminal coupled to the wireless transceiver 21", a second capacitor 26" having a first terminal coupled to the second terminal of the first capacitor and a second terminal, a first inductor 27" having a first terminal coupled to the second terminal of the second capacitor and a second terminal coupled to the second feed 49", and a second inductor 28"** having a first terminal coupled to the second terminal of the second capacitor and a second terminal coupled to a voltage reference.

Referring now to FIGS. 6-12, a circuit diagram 50 for simulating performance of the split antenna feed network 23 is now described. The schematic circuit diagram 50 illustratively includes first, second, and third resistors 54-56, and first and second capacitors 51-52 coupled to the first and third resistors. The schematic circuit diagram 50 illustratively includes first and second inductors 53-54 coupled to the first capacitor 51. The third resistor 56 represents the interface termination impedance to the antenna 24, typically about 50 Ohms. The first and second resistors 54, 55 in diagram 50 represent the effective feed impedances of elements in the antenna such as a patch or patches as seen at connections 48 and 49 in FIG. 1. These feed impedances may be a function of frequency. Diagram 60 shows amplitude response of the split antenna feed network 23. Curve 61 shows the signal amplitude at resistor 54 when excited by a signal applied at resistor 56. Curve 62 shows the signal amplitude at resistor 55 when excited by a signal applied at resistor 56. Advantageously, the amplitudes are equal in the low and high bands.

Figure 6:
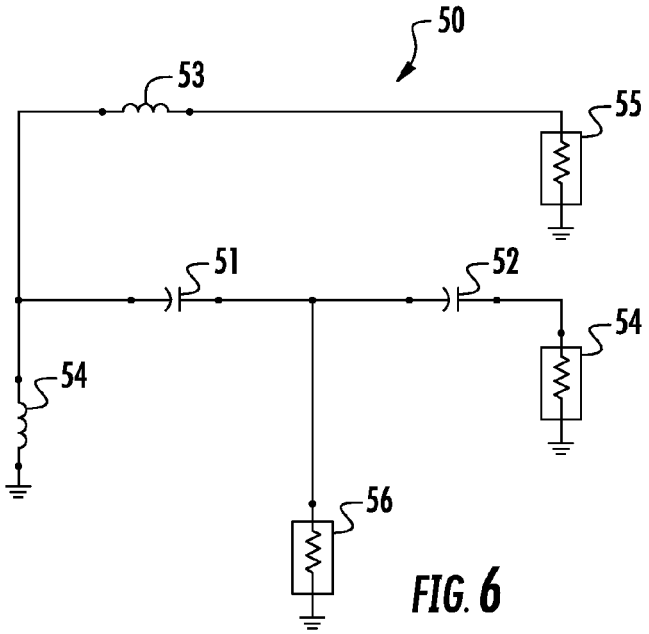
FIG. 6 is a schematic circuit diagram of an example embodiment of a split antenna feed network from the mobile wireless communications device of FIG. 1.
Figure 7:
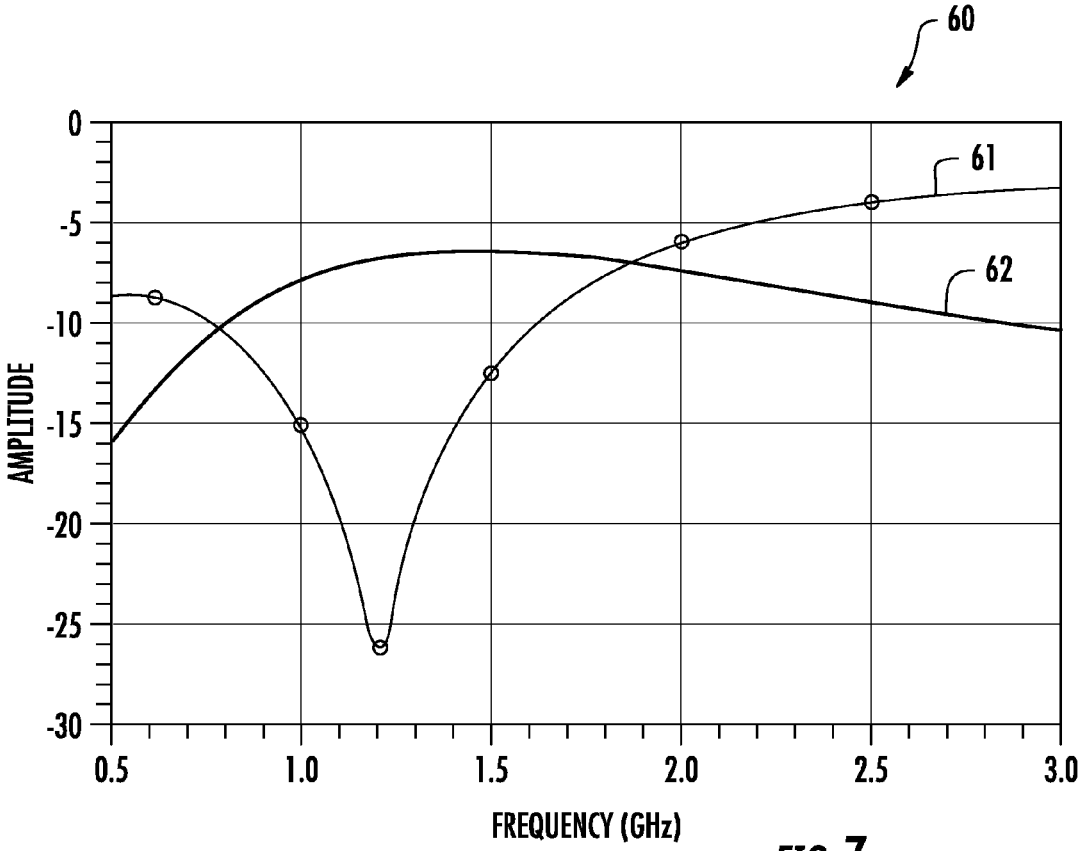
FIG. 7 is a diagram of amplitude response for the split antenna feed network of FIG. 6.
Figure 8:
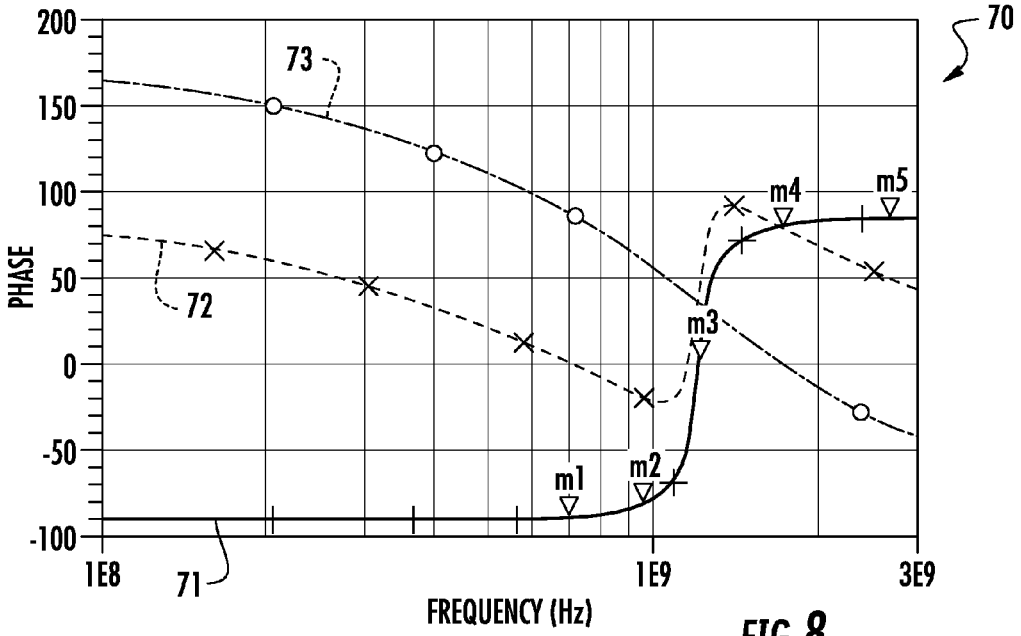
FIGS. 8-9 are diagrams of phase difference for the split antenna feed network of FIG. 6.
Figure 9:
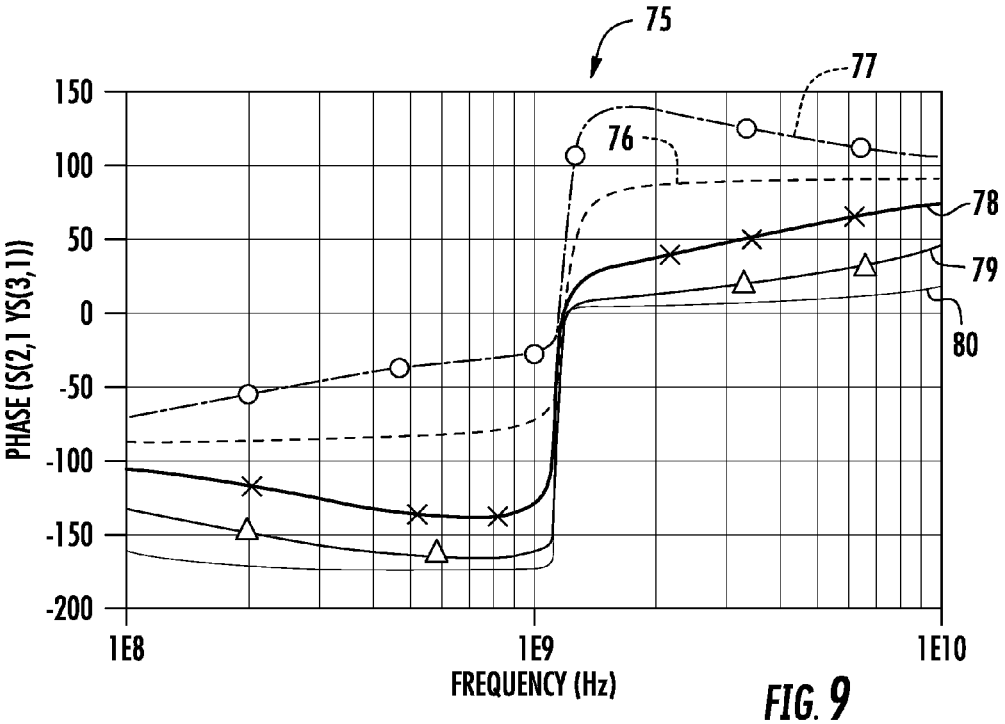
Figure 10:
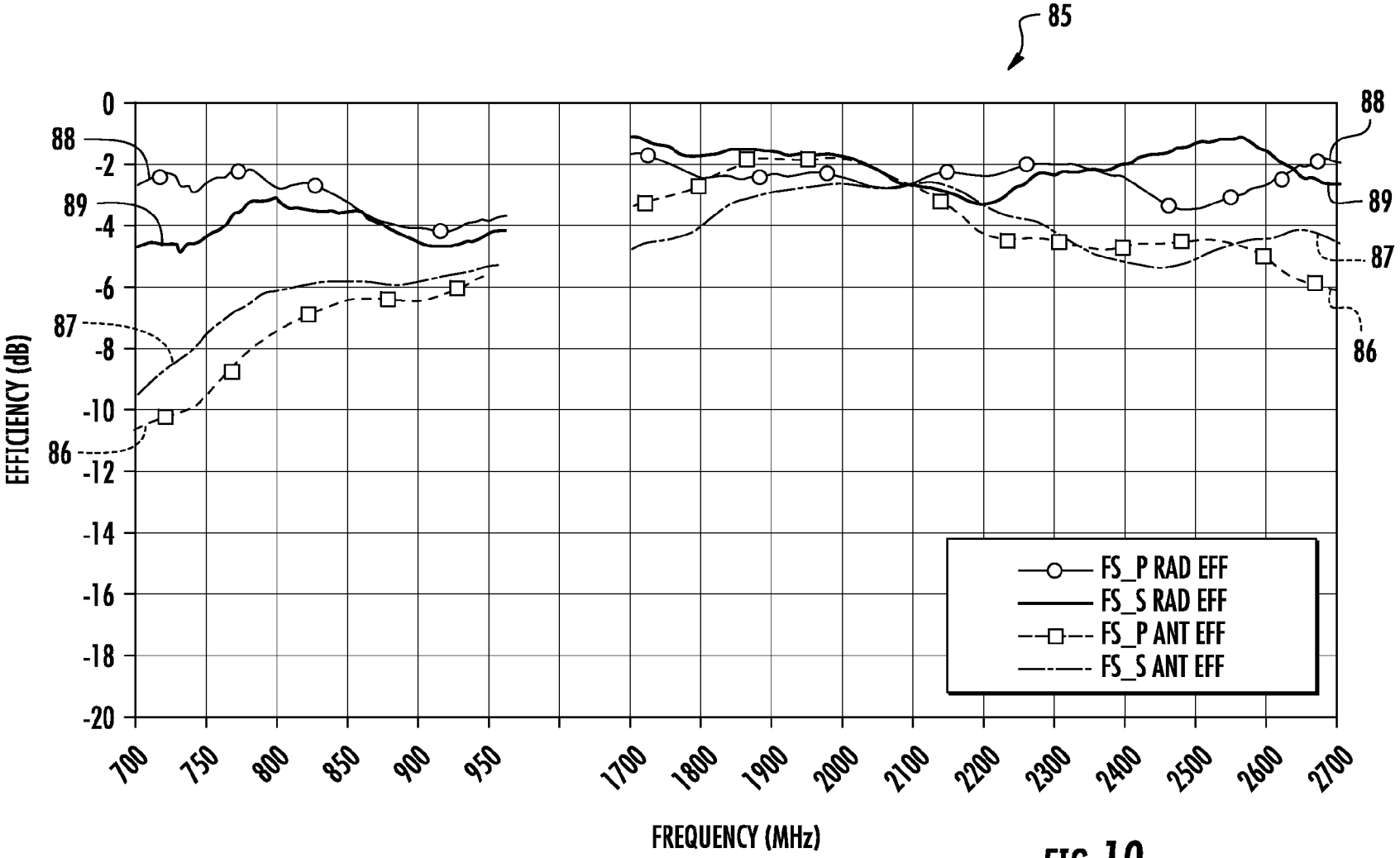
FIGS. 10-12 are diagrams of antenna efficiency for an example embodiment of the mobile wireless communications device.
Figure 11:
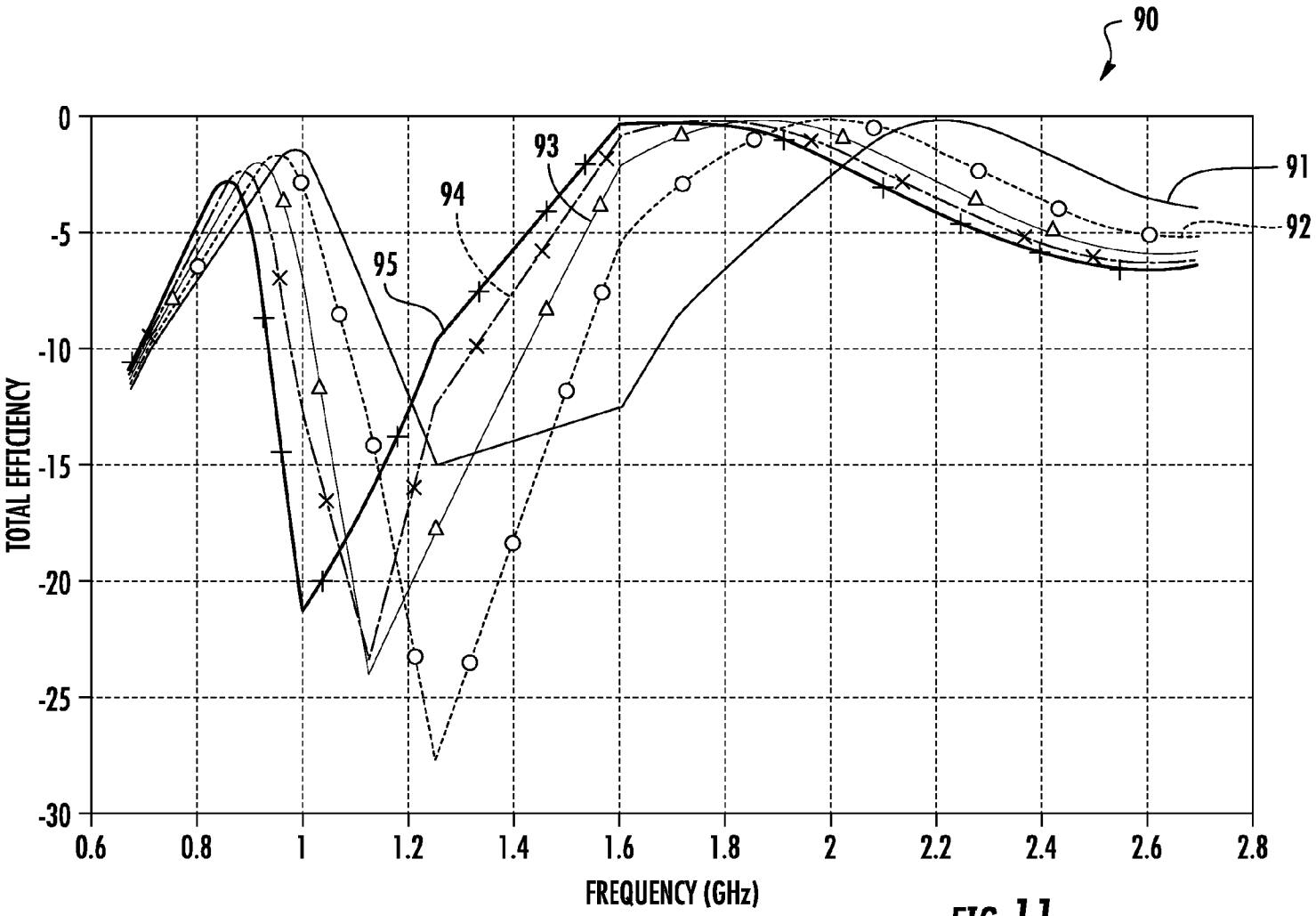
Figure 12:
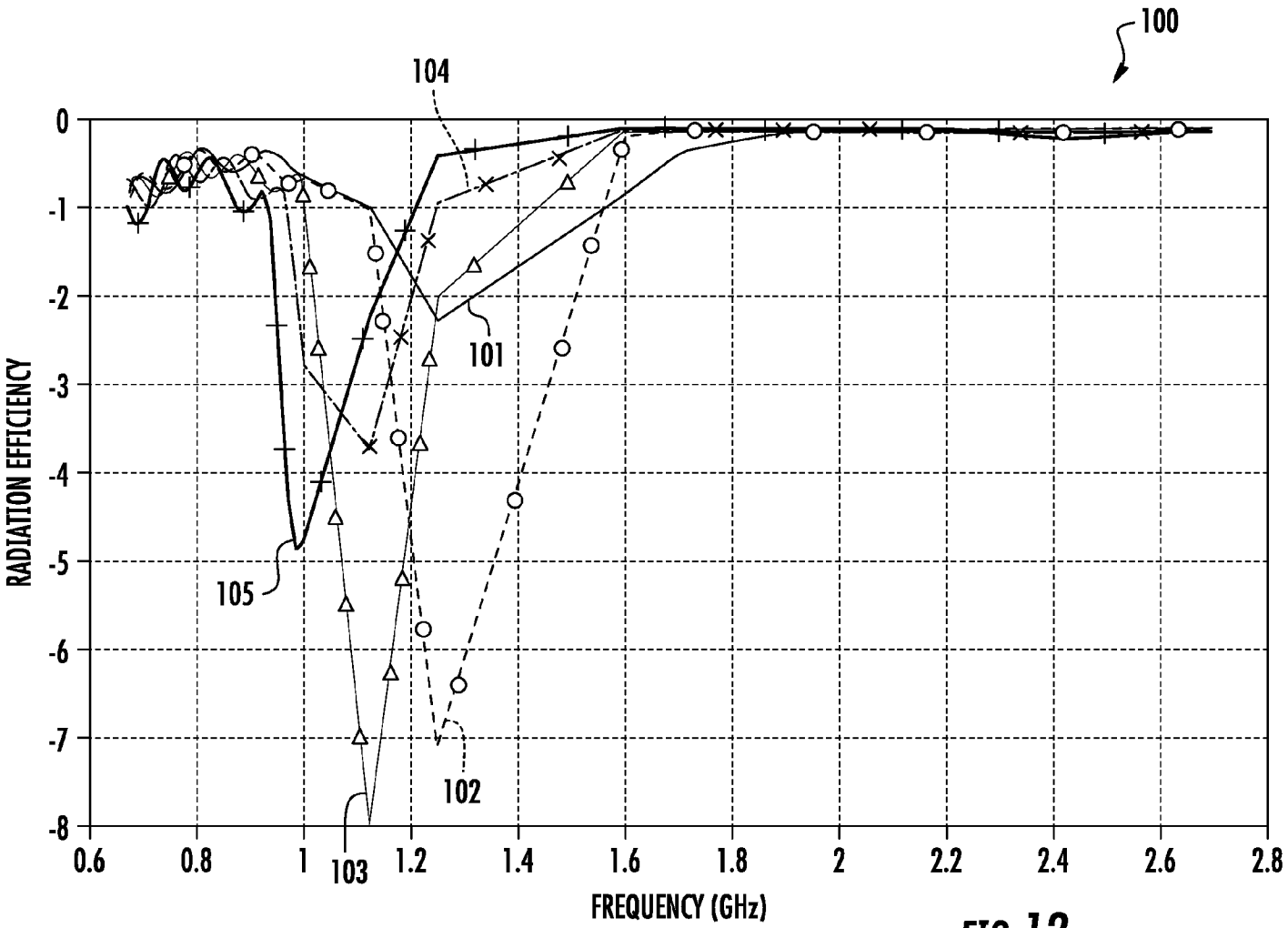

Diagram 70 shows the phase difference of the two amplitude responses 61 and 62 in diagram 60 from the three port circuit simulated in FIG. 6. Curves 72-73 show the simulated phases of the signals at resistors 54 and 55 in diagram 50 when stimulated by a signal applied at resistor 56. Curve 71 shows the phase difference between the two signals with m1-m5 data points (m1, 698.0 MHz, delta=−87.014; m2, 960.0 MHz, delta=−81.051; m3, 1205.0 MHz, delta=0.006; m4, 1710.0 MHz, delta=80.213; and m5, 2690.0 MHz, delta=85.262). Advantageously, the phase difference is maintained near the desired 90 degrees at both the low band and the high band (i.e. below 1 GHz and above 1.5 GHz).

Diagram 75 shows the phase response of an embodiment of phase splitter network 23, showing that the phase differences may be dependent on the effective impedances modeled by resistors 54 and 55 in diagram 50 of the antenna 24. At an effective resistance of around 158 Ohms for resistors 54, 55 in diagram 50, the ideal phase response may extend both very low and very high in frequency. This may enable the antenna performance to also extend in frequency well beyond a typical transmission line based transducer. Curves 76-80 show phase difference for varying antenna effective radiation resistances. Curve 76, in particular, shows an optimal 90 degrees phase difference between 50 and 500 Ohms.

Diagram 85 shows measured antenna efficiency performance of two split feed antennas in a cabled phone mockup. The dashed curves 86, 89 are the antenna efficiencies or antenna losses, and the solid curves 87-88 are the radiation efficiencies, which remove the mismatch loss at the RF feed. Using an impedance matching tuner at the RF feed, the antenna efficiency can approach the radiation efficiency. Advantageously, the radiation efficiency for the split feed antenna may be quite independent of frequency and shows no major resonances.

Diagrams 90, 100 show total antenna and radiation efficiencies, respectively, with tunable capacitors (FIG. 2) using a commercially available 3D electromagnetic simulator. Using a commercially available 0.4 to 1.2 pF variable capacitor for the first capacitor 25 with a fixed 5.5 pF capacitor for the second capacitor 26 allows tuning of both low and high bands. Curves 91-95 show antenna efficiency with varying value of capacitance the first capacitor 25 (i.e. respectively, 0.5 Pf, 0.75 Pf, 1.0 Pf, 1.25 Pf, and 1.5 Pf). Curves 101-105 show radiation efficiency with varying value of capacitance the first capacitor 25 (i.e. respectively, 0.5 Pf, 0.75 Pf, 1.0 Pf, 1.25 Pf, and 1.5 Pf; Frequency from 700-960 MHz).

Figure 13B:
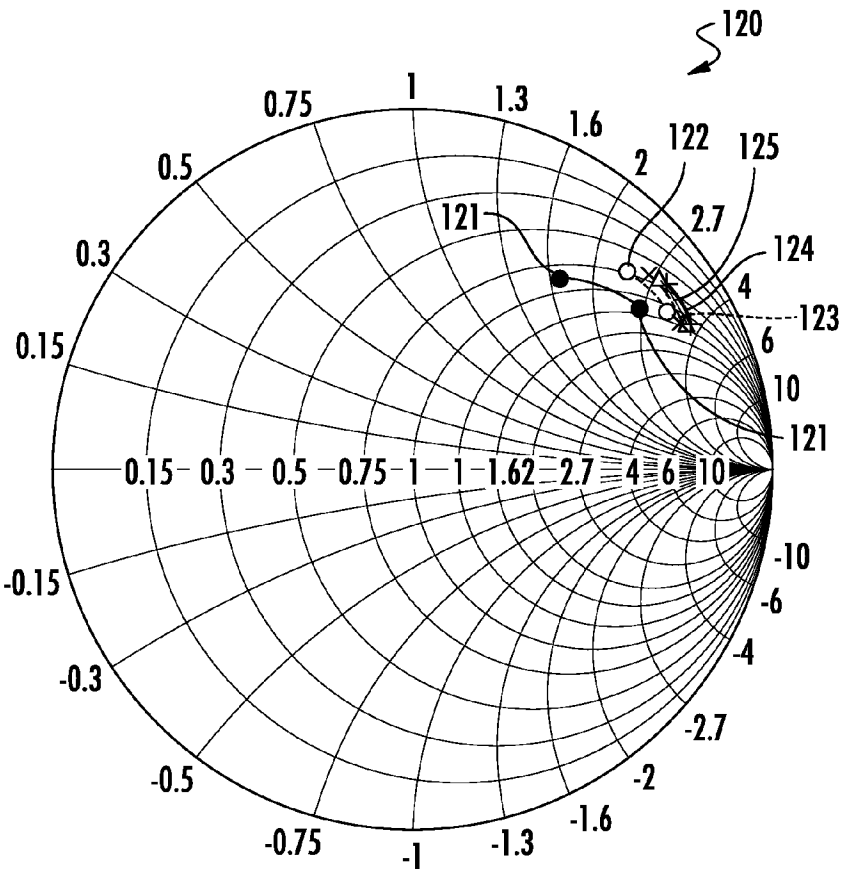
FIGS. 13A-13C are Smith diagrams for an example embodiment of the mobile wireless communications device.
Figure 13A:
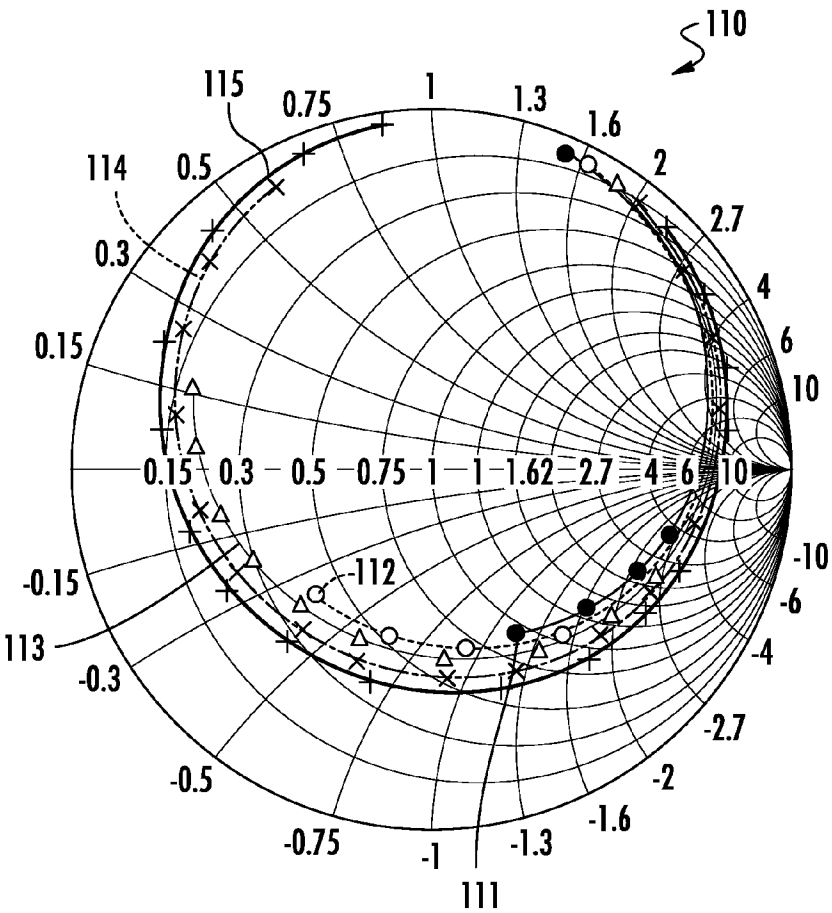
Figure 13C:
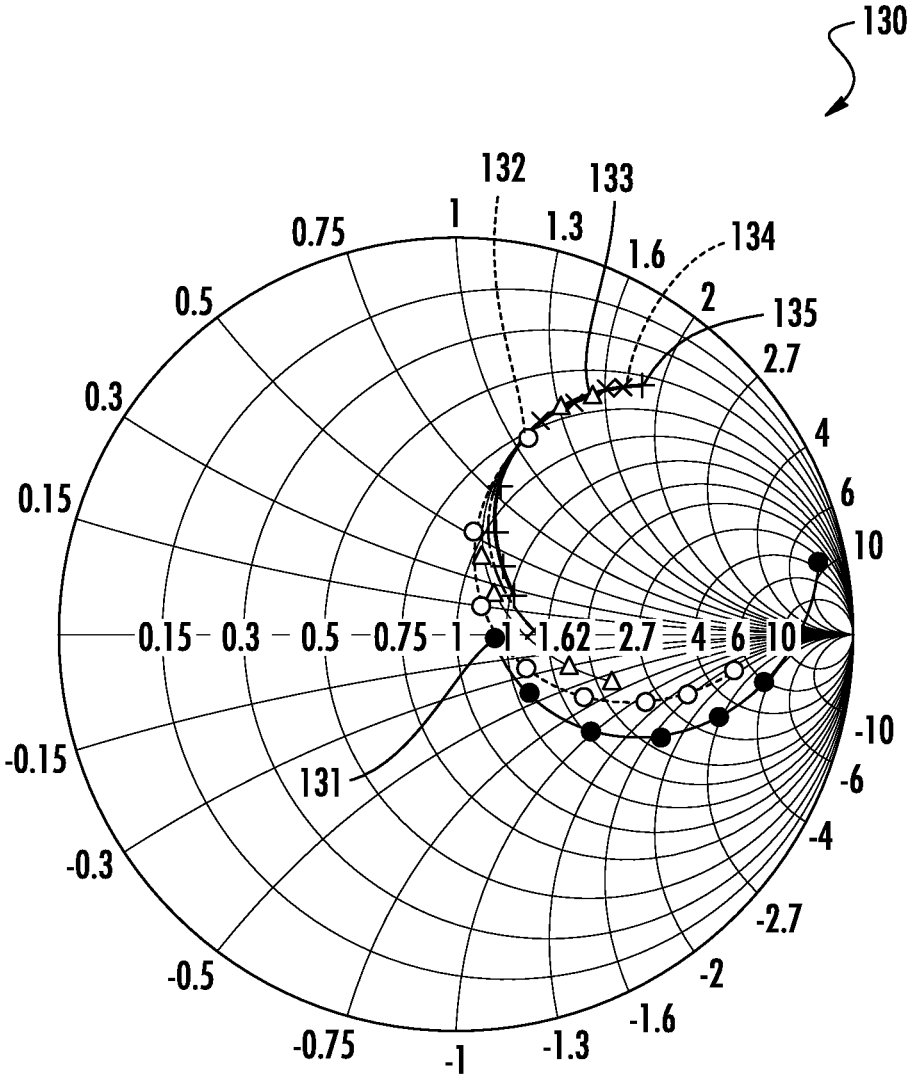

Referring now additionally to FIGS. 13A-13C, diagrams 110, 120, 130 show Smith charts of the simulated antenna input impedance for the mobile wireless communications device 20 at varying operating frequencies. The antenna 24 becomes impedance matched for best efficiency as the impedance traces approach the center of the Smith chart. In the simulations, the second capacitor 26 is held fixed at 5.5 pF. Curves 111-115 show antenna input impedance curves for the antenna 24 with varying capacitance values for the first capacitor 25 (i.e. respectively, 0.5 Pf, 0.75 Pf, 1.0 Pf, 1.25 Pf, and 1.5 Pf) over a frequency range of 700 MHz to 960 MHz. Curves 120-125 show antenna input impedance curves for the antenna 24 with varying capacitance values for the first capacitor 25 (i.e. respectively, 0.5 Pf, 0.75 Pf, 1.0 Pf, 1.25 Pf, and 1.5 Pf) over a frequency range of 1700 MHz to 2200 MHz. Curves 131-135 show antenna input impedance curves for the antenna 24 with varying capacitance values for the first capacitor 25 (i.e. respectively, 0.5 Pf, 0.75 Pf, 1.0 Pf, 1.25 Pf, and 1.5 Pf) over a frequency range of 2500 MHz to 2700 MHz. Effective impedance matching is accomplished over some frequency ranges using a variable capacitor for capacitor 25 in the split feed antenna. Additionally, the impedance matching circuit 22 could be used to further improve efficiency.

In the following, an exemplary discussion of the mobile wireless communications device 20 now follows. The split feed antenna disclosed may provide high antenna radiation efficiency and small size over large bandwidths by using a phase splitting transducer approach (FIG. 3). An RF signal is input to a split antenna feed network 23" with two outputs that maintain an approximately constant 90 degree relative phase difference over large bandwidths. The two outputs of the split antenna feed network 23" are connected at two locations on the transducer. This phase difference can be made to nearly constant over multiple communication bands, resulting in good antenna radiation efficiency performance over bandwidths that extend both lower and higher in frequency compared to a conventional antenna design.

The split antenna feed network 23" can be made using any of many microwave circuit techniques for making 90 degree phase shifters including using high pass and low pass filters, different transmission line lengths, and quadrature couplers. It may be important for the outputs of the split antenna feed network 23" to provide enough isolation for the RF signal to be supported on the transducer. Ideally, the split antenna feed network 23" should maintain a constant phase difference between the outputs and their amplitudes should be equal over frequency. However, very good antenna performance can be achieved with less than ideal phase splitter performance, accommodating practical compromises in transducer size and complexity.

The embodiment of the phase splitter network 23" as shown in FIG. 3 uses a small value series capacitor C1 25" for one output of the phase splitting network and a larger value series capacitor C2 26", a shunt inductor L2 28", and a series inductor L1 27" for the other output. The impedance of the transducer affects the value of the phase difference, so that the phase splitting network and the transducer need to be optimized together (see FIG. 9). This simple network may achieve low loss and good phase control. The embodiment has a single natural resonant frequency where the phase reverses from a leading (or trailing) 90 degrees to a trailing (or leading) 90 degrees between the outputs. This resonant frequency can be designed to occur between the major frequency bands of operation so as to minimize the negative impact on the operation of the antenna 24*a*"-24*b*". The embodiment provides adequate isolation between the RF signal outputs.

Other embodiments of the split feed antenna utilizing a frequency independent transducer are possible, including modifying, eliminating, or adding components to the phase splitting network. The performance of the antenna can be optimized or tuned for specific conditions by using tunable capacitors to replace C1, C2, C3 25"-26", 38" in the phase splitter network as shown in FIG. 3.

Example components of a mobile wireless communications device 1000 that may be used in accordance with the above-described embodiments are further described below with reference to FIG. 14. The device 1000 illustratively includes a housing 1200, a keyboard or keypad 1400 and an output device 1600. The output device shown is a display 1600, which may comprise a full graphic liquid crystal display (LCD). Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 14:
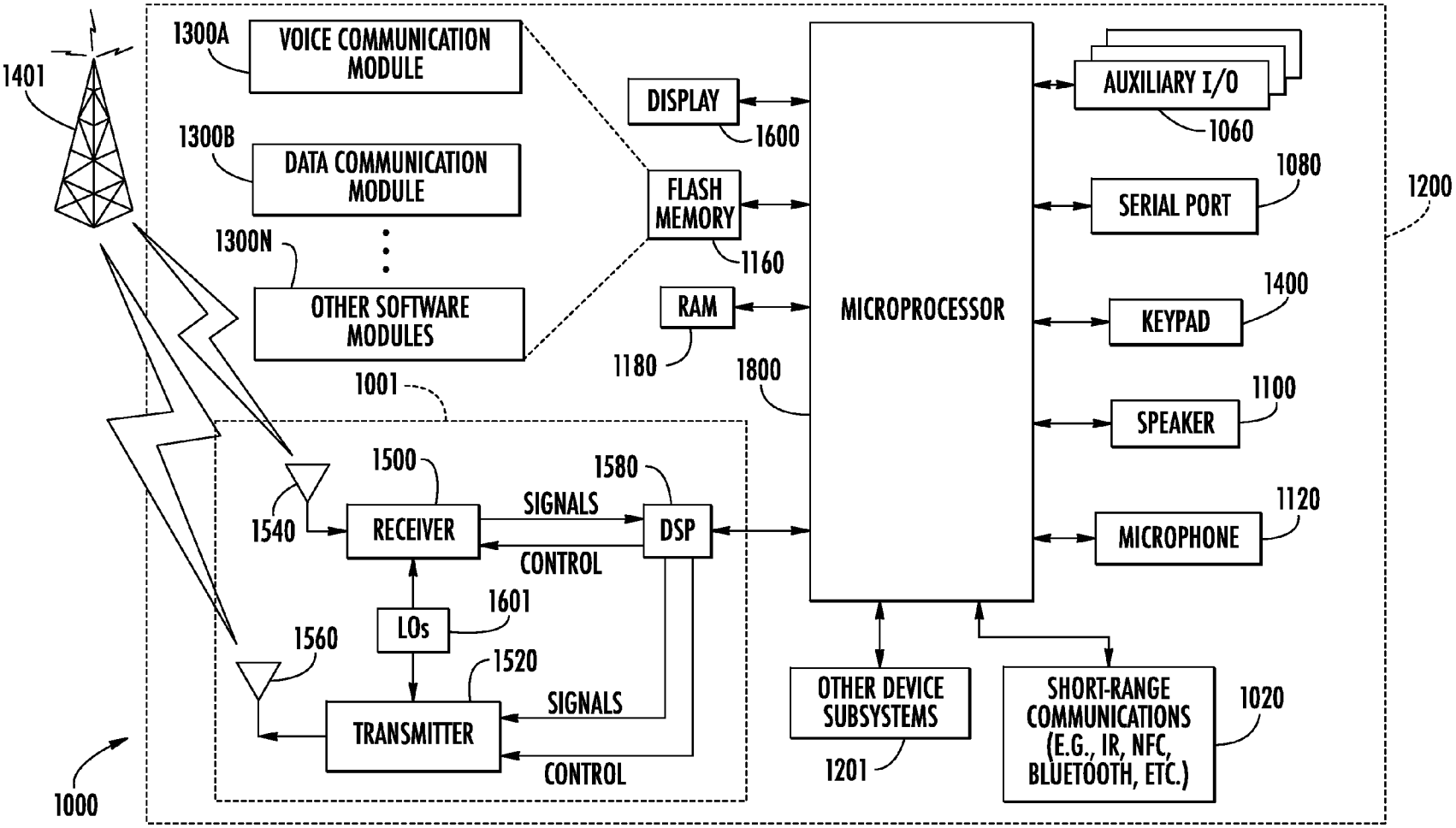
FIG. 14 is a schematic block diagram illustrating example components of a mobile wireless communications device that may be used with the mobile wireless communications device of FIG. 1.

In addition to the processing device 1800, other parts of the mobile device 1000 are shown schematically in FIG. 14.

These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem 1020. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TACT™ or General Packet Radio Service (GPRS) mobile data communications networks, and also designed to operate with any of a variety of voice communications networks, such as Advanced Mobile Phone System (AMPS), time division multiple access (TDMA), code division multiple access (CDMA), Wideband code division multiple access (W-CDMA), personal communications service (PCS), GSM (Global System for Mobile Communications), enhanced data rates for GSM evolution (EDGE), etc. Other types of data and voice networks, both separate and integrated, may also be utilized with the mobile device 1000. The mobile device 1000 may also be compliant with other communications standards such as 3GSM, 3rd Generation Partnership Project (3GPP), Universal Mobile Telecommunications System (UMTS), 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a NFC sensor for communicating with a NFC device or NFC tag via NFC communications.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:
a housing including a carrier having front surface and a back surface joined together along a peripheral edge;
a wireless transceiver carried by said housing;
at least one antenna element formed on said carrier, extending across the peripheral edge, onto both the front surface and the back surface and comprising a first feed and a second feed, wherein the at least one antenna element is a multi-band antenna, and wherein the first feed defines a high-band feed supporting high-band operation and the second feed defines a low-band feed supporting low-band operation; and
a split antenna feed network carried by said housing and configured to maintain a phase difference of about 90 degrees between the high-band feed and the low-band feed, said split antenna feed network comprising:
a first circuit leg between a common node and the first feed, wherein the first circuit leg comprises a first capacitor having a first terminal coupled to the first feed and a second terminal coupled to the common node, wherein the common node is in communication with the wireless transceiver; and
a second circuit leg between the common node and the low-band feed, wherein the second circuit leg comprises:
a second capacitor having a first terminal coupled to the low-band feed and a second terminal;
a first inductor having a first terminal coupled to the second terminal of the first capacitor and a second terminal coupled to the second terminal of the second capacitor by way of the common node; and
a second inductor having a first terminal coupled to the second terminal of the second capacitor and a second terminal coupled to a reference voltage.

2. The mobile wireless communications device of claim 1 wherein said first and second capacitors each comprises a tunable capacitor, wherein the at least one antenna element is a multi-band antenna, and wherein the first feed defines a high-band feed and the low-band feed defines a low-band feed.

3. The mobile wireless communications device of claim 2 wherein each tunable capacitor comprises at least one of a varactor, a tunable capacitor, a varactor diode, a semiconductor switched capacitor, and a microelectromechanical varactor.

4. The mobile wireless communications device of claim 1 further comprising an impedance matching circuit coupled between said wireless transceiver and said common node of said split antenna feed network and configured to match impedances therebetween, wherein the first capacitor and the second capacitor are positioned along the back surface of the housing.

5. The mobile wireless communications device of claim 4 wherein said impedance matching circuit comprises:
a third inductor having a first terminal coupled to the wireless transceiver and a second terminal;
a third capacitor having a first terminal coupled to the second terminal of said third inductor and a second terminal coupled to the split antenna feed network;
a fourth capacitor having a first terminal coupled to the wireless transceiver and a second terminal coupled to the reference voltage;
a fourth inductor having a first terminal coupled to the wireless transceiver and a second terminal coupled to the reference voltage;
a fifth capacitor having a first terminal coupled to the split antenna feed network and a second terminal coupled to the reference voltage; and
a fifth inductor having a first terminal coupled to the split antenna feed network and a second terminal coupled to the reference voltage.

6. The mobile wireless communications device of claim 1 wherein an antenna efficiency approaches a radiation efficiency across high-band and the low-band operation, and wherein the phase difference is greater than 80 degrees.

7. The mobile wireless communications device of claim 1 wherein said at least one antenna element comprises:
a medial rectangle-shaped portion extending along the back surface;
a first L-shaped arm extending from the medial rectangle-shaped portion and along the back surface;
a first rectangle-shaped portion extending from the medial rectangle-shaped portion and along a bottom peripheral edge of the carrier;
a second rectangle-shaped portion extending from the first rectangle-shaped portion and along the front surface; and
wherein the phase difference is greater than 80 degrees.

8. The mobile wireless communications device of claim 1 wherein the phase difference is maintained near 90 degrees below 1 GHz and above 1.5 GHz.

9. A mobile wireless communications device comprising:
a housing including a front surface and a back surface joined together along a peripheral edge;
a wireless transceiver carried by said housing;
at least one antenna element formed on a carrier, extending across a peripheral edge, onto both a front surface and a back surface and comprising a high-band feed and a low-band feed, wherein the at least one antenna element is a multi-band antenna; and
a split antenna feed network carried by said housing and configured to maintain a phase difference of about 90 degrees between the high-band feed and the low-band feed, said split antenna feed network comprising:
a first circuit leg between a common node and the high-band feed, wherein the first circuit leg comprises a first capacitor having a first terminal coupled to the high-band feed and a second terminal coupled to the common node, wherein the common node is in communication with the wireless transceiver; and
a second circuit leg between the common node and the low-band feed, wherein the second circuit leg comprises:
a second capacitor having a first terminal coupled to the second terminal of said first capacitor and a second terminal;
a first inductor having a first terminal coupled to the second terminal of the second capacitor and a second terminal coupled to the low-band feed by way of the common node; and
a second inductor having a first terminal coupled to the second terminal of the second capacitor and a second terminal coupled to a reference voltage.

10. The mobile wireless communications device of claim 9 wherein said first and second capacitors each comprises a tunable capacitor.

11. The mobile wireless communications device of claim 10 wherein each tunable capacitor comprises at least one of a varactor, a tunable capacitor, a varactor diode, a semiconductor switched capacitor, and a microelectromechanical varactor.

12. The mobile wireless communications device of claim 9 further comprising an impedance matching circuit coupled between said wireless transceiver and said split antenna feed network and configured to match impedances therebetween.

13. The mobile wireless communications device of claim 12 wherein said impedance matching circuit comprises:

a third inductor having a first terminal coupled to the wireless transceiver and a second terminal;

a third capacitor having a first terminal coupled to the second terminal of said third inductor and a second terminal coupled to the split antenna feed network;

a fourth capacitor having a first terminal coupled to the wireless transceiver and a second terminal coupled to the reference voltage;

a fourth inductor having a first terminal coupled to the wireless transceiver and a second terminal coupled to the reference voltage;

a fifth capacitor having a first terminal coupled to the split antenna feed network and a second terminal coupled to the reference voltage; and a fifth inductor having a first terminal coupled to the split antenna feed network and a second terminal coupled to the reference voltage.

14. The mobile wireless communications device of claim 9, wherein the first capacitor and the second capacitor are positioned along the back surface of the housing, and wherein said split antenna feed network is configured to provide a 90 degree phase shift between the high-band feed and the low-band feed.

15. The mobile wireless communications device of claim 9 wherein said at least one antenna element comprises:

a medial rectangle-shaped portion extending along the back surface;

a first L-shaped arm extending from the medial rectangle-shaped portion and along the back surface;

a first rectangle-shaped portion extending from the medial rectangle-shaped portion and along a bottom peripheral edge of the carrier; and a second rectangle-shaped portion extending from the first rectangle-shaped portion and along the front surface.

16. The mobile wireless communications device of claim 9 wherein said at least one antenna element comprises first and second antenna elements; and further comprising a sixth capacitor coupled between said first and second antenna elements.

17. A method for making a split antenna feed network for a mobile wireless communications device having a wireless transceiver to be carried by a housing including a front surface and a back surface joined together along a peripheral edge, and at least one multi-band antenna comprising at least one antenna element to be formed on a carrier, extending across a peripheral edge, onto both a front surface and a back surface and comprising a high-band feed and a low-band feed, the split antenna feed network to be coupled to the wireless transceiver and maintaining a phase shift of between about 80-90 degrees, between the high-band feed and the low-band feed, the method comprising:

forming the split antenna feed network to comprise;

a first circuit leg between a common node and the high-band feed, wherein the first circuit leg comprises a first capacitor having a first terminal coupled to the high-band feed and a second terminal coupled to the common node, wherein the common node is in communication with the wireless transceiver; and a second circuit leg between the common node and the low-band feed, wherein the second circuit leg comprises:

a second capacitor having a first terminal coupled to the low-band feed and a second terminal;

a first inductor having a first terminal coupled to the second terminal of the first capacitor and a second terminal coupled to the second terminal of the second capacitor by way of the common node; and a second inductor having a first terminal coupled to the second terminal of the second capacitor and a second terminal coupled to a voltage reference.

18. The method of claim 17 wherein the first and second capacitors each comprises a tunable capacitor, and wherein the first capacitor and the second capacitor are positioned along the back surface of the housing.

19. The method of claim 18 wherein each tunable capacitor comprises at least one of a varactor, a tunable capacitor, a varactor diode, a semiconductor switched capacitor, and a microelectromechanical varactor.

20. The method of claim 17 further comprising coupling an impedance matching circuit between the wireless transceiver and the split antenna feed network and to match impedances therebetween.

21. The method of claim 17 wherein the split antenna feed network provides a 90 degree phase shift between the high-band feed and the low-band feed.

22. The method of claim 17 wherein the at least one antenna element comprises a patch antenna element.

23. The method of claim 17 wherein the at least one antenna element comprises:

a medial rectangle-shaped portion extending along the back surface;

a first L-shaped arm extending from the medial rectangle-shaped portion and along the back surface;

a first rectangle-shaped portion extending from the medial rectangle-shaped portion and along a bottom peripheral edge of the carrier; and a second rectangle-shaped portion extending from the first rectangle-shaped portion and along the front surface.

24. A method for making a split antenna feed network for a mobile wireless communications device having a wireless transceiver to be carried by a housing including a front surface and a back surface joined together along a peripheral edge, and at least one multi-band antenna element to be formed on a carrier, extending across a peripheral edge, onto both a front surface and a back surface and comprising a high-band feed and a low-band feed, the split antenna feed network to be coupled to the wireless transceiver and providing a phase shift between the high-band feed and the low-band feed of between about 80-90 degrees, the method comprising:

forming the split antenna feed network to comprise;

a first circuit leg between a common node and the high-band feed, wherein the first circuit leg comprises a first capacitor having a first terminal coupled to the high-band feed and a second terminal coupled to the common node, wherein the common node is in communication with the wireless transceiver; and a second circuit leg between the common node and the low band feed, wherein the second circuit leg comprises:

a second capacitor having a first terminal coupled to the second terminal of the first capacitor and a second terminal;

a first inductor having a first terminal coupled to the second terminal of the second capacitor and a second terminal coupled to the low-band feed by way of the common node; and a second inductor having a first terminal coupled to the second terminal of the second capacitor and a second terminal coupled to a voltage reference.

25. The method of claim 24 wherein the first and second capacitors each comprises a tunable capacitor.

26. The method of claim 25 wherein each tunable capacitor comprises at least one of a varactor, a tunable capacitor, a varactor diode, a semiconductor switched capacitor, and a microelectromechanical varactor.

27. The method of claim 24 further comprising coupling an impedance matching circuit between the wireless transceiver and the split antenna feed network and to match impedances therebetween.

28. The method of claim 24 wherein the split antenna feed network provides a 90 degree phase shift between the high-band feed and the low band feed.

29. The method of claim 24 wherein the at least one multi-band antenna element comprises a multi-band antenna element; and wherein the high-band feed defines a high band feed, and the low band feed defines a low band feed.

30. The method of claim 24 wherein the at least one multi-band antenna element comprises first and second antenna elements; and further comprising coupling a sixth capacitor between the first and second antenna elements.

* * * * *